US006424205B1

(12) United States Patent
Kadanka

(10) Patent No.: US 6,424,205 B1
(45) Date of Patent: Jul. 23, 2002

(54) LOW VOLTAGE ACMOS REFERENCE WITH IMPROVED PSRR

(75) Inventor: Petr Kadanka, Valasska Bystrice (CZ)

(73) Assignee: Semiconductor Components Industries LLC, Phoenix, AZ (US)

( * ) Notice: Subject to any disclaimer, the term of this patent is extended or adjusted under 35 U.S.C. 154(b) by 0 days.

(21) Appl. No.: 09/633,773

(22) Filed: Aug. 7, 2000

(51) Int. Cl.[7] ..... G05F 1/10; G05F 3/02
(52) U.S. Cl. ..... 327/543; 327/541
(58) Field of Search ..... 327/538, 540, 327/541, 543; 323/315

(56) References Cited

U.S. PATENT DOCUMENTS 5,362,988 A * 11/1994 Hellums ..... 327/543
5,903,141 A * 5/1999 Tailliet ..... 323/312
5,910,749 A * 6/1999 Kimura ..... 327/541

* cited by examiner

*Primary Examiner*—Terry D. Cunningham
*Assistant Examiner*—Quan Tra

(57) ABSTRACT

A stable voltage reference (12) receives an unregulated voltage ($V_{dd}$) as input and provides a low voltage, stable output reference ($V_{REF}$). Voltage reference (12) utilizes a cascaded reference cell configuration where the first reference cell comprises a constant current source (18) and a diode (20) and the second reference cell comprises a constant current source (26) and a diode (28). A buffer (24) is configured as a source follower which allows cascading of the two reference cells with minimal voltage drop while providing improved PSRR performance.

23 Claims, 2 Drawing Sheets

LOW VOLTAGE ACMOS REFERENCE WITH IMPROVED PSRR

BACKGROUND OF THE INVENTION

The present invention relates in general to stable voltage references and, more particularly, to voltage references which exhibit improved power supply rejection ratio (PSRR).

Stable voltage references are required for utilization circuits whose performance would be degraded if not for the isolation and stabilization characteristics that these voltage references provide. A broad array of utilization circuits which require such voltage references for isolation and stabilization include A/D converters, switched mode power supplies and voltage regulators to name only a few.

Techniques exist today which employ a single stage voltage reference cell to provide a stable voltage reference derived from a relatively noisy and unregulated voltage source or potential. The voltage source can be a voltage bus which is shared by other circuits co-resident within a given integrated circuit or a voltage grid which is shared by multiple integrated circuits. Since the voltage bus or grid is shared by many circuits, the bus or grid tends to conductively couple the transient voltage signals of its constituent circuits. These transient voltage signals appear as noise on the voltage bus or grid and generally induce undesirable effects within each circuit connected to it.

Prior art voltage references employ a single stage or single voltage reference cell to develop an output voltage, which is relatively isolated from its input. Many such stages or cells consist of two transistors, typically implemented using field effect transistors which are connected in series to one another. Typically, the source of the first transistor is connected to the drain of the second transistor and the combination is connected between an unregulated voltage supply bus and ground. An explanation of the operation of the prior art single stage voltage reference follows.

The first transistor of the single stage voltage reference is generally configured as a depletion mode transistor and supplies a constant current to the second transistor, generally configured as an enhanced mode transistor, whose drain voltage is used as the output or stable voltage source. The second transistor is generally configured in a diode fashion, i.e. the transistor's gate and drain are electronically connected together. The output voltage of the voltage reference is derived at the gate terminal of the second transistor and is characterized to operate independently from the unregulated voltage supply potential which is coupled to the drain terminal of the first transistor.

Integrated circuits today are called upon to operate in increasingly noisy environments. Power supply buses are effective conductors of noise and they provide efficient transports of noise to all circuits connected to them. One way to reduce the overall noise level within these circuits is to design superior voltage references whose stability and power supply rejection performance characteristics are superior to the prior art voltage references. Using voltage references, which exhibit greater PSRR values, less noise would be coupled through the power supply inputs to these devices thereby increasing their noise immunity.

Hence, a need exists for a voltage reference cell which exhibits improved power supply rejection ratio (PSRR).

DETAILED DESCRIPTION OF THE PREFERRED EMBODIMENT

Figure 1:
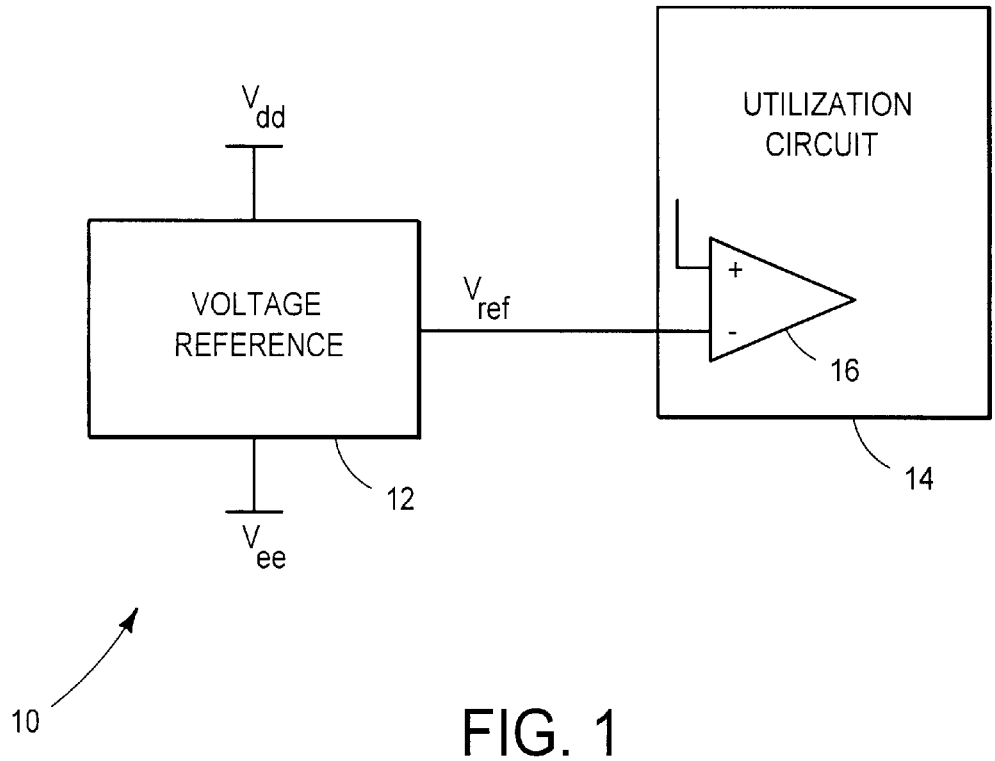
FIG. 1 illustrates a utilization circuit requiring a stable voltage reference.

Referring to FIG. 1, circuit 10 as shown is comprised of a stable voltage reference 12 and a utilization circuit 14. Voltage reference 12 receives an unregulated voltage potential $V_{dd}$ and supplies a regulated voltage reference $V_{REF}$. The voltage reference 12 may be implemented on a 3–4 pin integrated circuit where an unregulated voltage potential input pin $V_{dd}$ accepts the unregulated voltage potential. A regulated voltage reference pin $V_{REF}$ supplies utilization circuit 14 with a regulated voltage reference $V_{REF}$ which is substantially independent of the unregulated voltage potential $V_{dd}$. Utilization circuit 14 comprises, for example, comparator circuit 16, which accepts the regulated voltage reference $V_{REF}$ at the inverting input of comparator circuit 16 and compares $V_{REF}$ with a feedback signal at the non-inverting input of comparator circuit 16. It is understood that other circuits can exist within utilization circuit 14, some of which may utilize the regulated voltage reference $V_{REF}$. Voltage reference 12 is referenced to a second input voltage potential at pin $V_{ee}$, typically operating at ground potential. Voltage reference 12 may be implemented in large scale integrated circuit applications where hundreds or thousands of circuits exist on the same integrated circuit. The voltage reference 12, accordingly, exists internal to the integrated circuit and provides a stable voltage reference for circuits within the integrated circuit.

Figure 2:
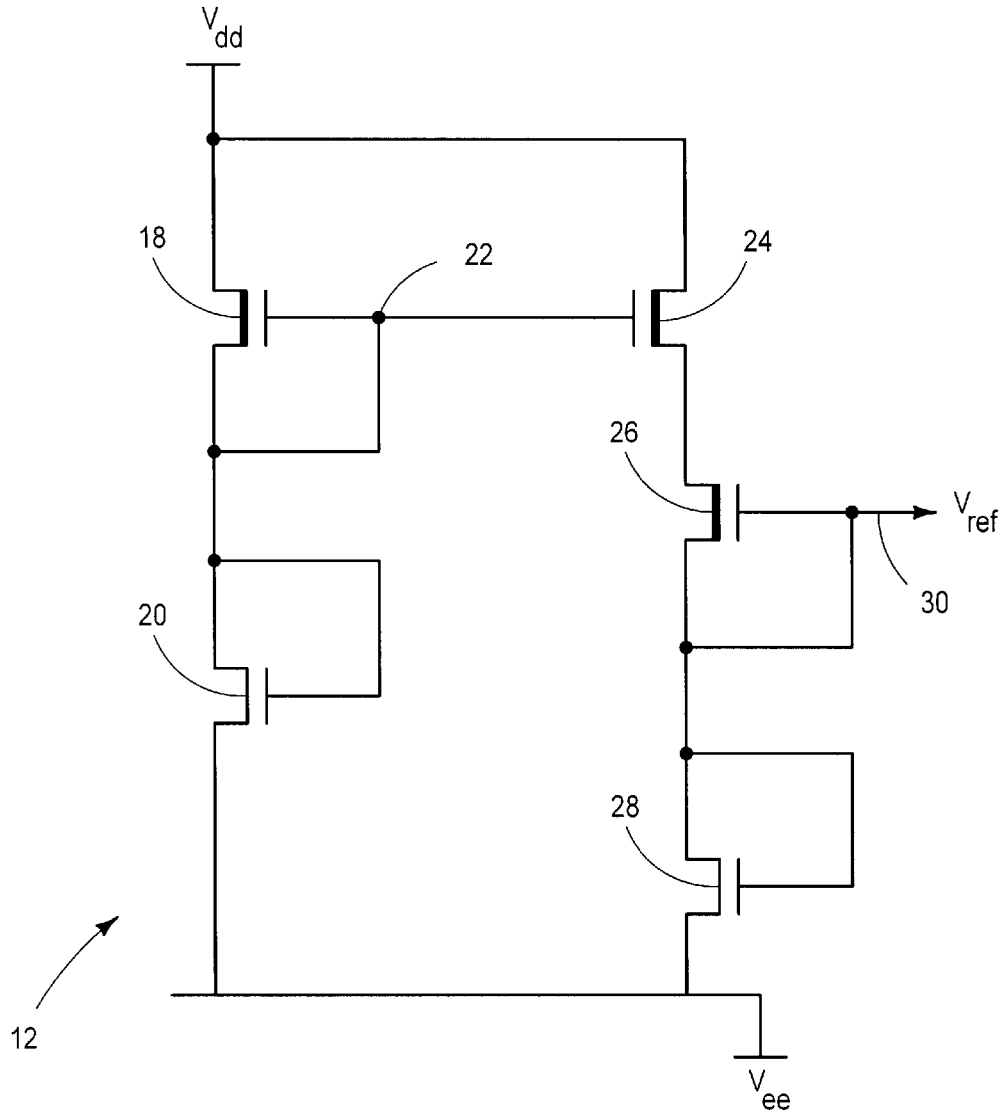
FIG. 2 illustrates a schematic diagram of a stable voltage reference.

FIG. 2 displays a detailed schematic of voltage reference 12 and a detailed explanation of the operation of the circuit of FIG. 2 follows. An unregulated voltage potential is coupled to the drain of depletion mode transistor 18 at node $V_{dd}$. The gate terminal of transistor 18 is coupled to the source terminal of transistor 18 at node 22. The drain terminal of enhanced mode transistor 20 is coupled to the source terminal of transistor 18 at node 22, which in turn, is coupled to the gate terminal of transistor 20. The source terminal of transistor 20 is then coupled to the second input voltage potential at terminal $V_{ee}$.

The threshold voltage of depletion mode transistor 18 is negative which provides for a small amount of drain current to flow through transistor 18 even with a zero volt bias applied across the gate and source terminals of transistor 18. A zero volt bias difference across the gate and source terminals of transistor 18 is provided by the connection between the gate and source terminals of transistor 18 at node 22. Coupling the gate and source terminals of depletion mode transistor 18 together at node 22 configures transistor 18 as a constant current source. The amount of current supplied by depletion mode transistor 18 depends upon the physical dimensions of transistor 18.

The source terminal of transistor 18 is coupled to the drain terminal of transistor 20, which is also coupled to the gate terminal of transistor 18 at node 22. Transistor 20 is configured as an enhanced mode transistor, which provides a positive threshold voltage dependent upon the physical dimensions of transistor 20. The gate and drain terminals of transistor 20 are coupled together to form a diode connected transistor. The voltage existing on the gate terminal of transistor 20, and therefore also on the drain terminal of transistor 20, is set according to the threshold voltage of transistor 20. The source terminal of transistor 18 is coupled to the drain terminal of transistor 20 and also coupled to the gate terminal of transistor 18. The voltage at the gate terminal of transistor 18 is therefore set by the threshold voltage of transistor 20 which is positive and is provided at node 22. The voltage generated at node 22 is dependent upon the threshold voltage of transistor 20 and is therefore substantially independent of the unregulated voltage potential $V_{dd}$. The series combination of transistor 18 and transistor 20 as shown in FIG. 2, make up a single voltage reference cell which generates a pre-stabilized voltage provided at the gate terminal of transistor 24 at node 22.

An unregulated voltage potential is coupled to the drain terminal of depletion mode transistor 24 at terminal $V_{dd}$. The pre-stabilized voltage at node 22 is coupled to the gate terminal of transistor 24. Transistor 24 is a high input impedance buffer accepting the pre-stabilized voltage output from the voltage cell comprised of transistor 18 and transistor 20 at node 22 and supplying a buffered, pre-stabilized voltage to the voltage cell comprised of transistor 26 and transistor 28, at the drain terminal of transistor 26. Transistor 24 is the only load connected to node 22 and due to the high input impedance of transistor 24, provides negligible loading effects. Transistor 24 is configured as a source follower whereby the voltage on the source terminal of transistor 24 tracks the voltage present on the gate terminal of transistor 24. Transistor 24 is therefore tracking the pre-stabilized voltage at node 22. Transistor 24 is largely unaffected by any change in the unregulated voltage potential $V_{dd}$ due to the source follower characteristics of transistor 24 and therefore substantially increases the PSRR performance of voltage reference 12.

Voltage on the source terminal of transistor 24 supplies potential to the drain terminal of depletion mode transistor 26. Transistor 26 is preferably, but not necessarily, identical to transistor 18. Transistor 26 provides a source of constant current to enhanced mode transistor 28. Transistor 28 is preferably, but not necessarily, identical to transistor 20. Transistor 28 is diode connected to provide a constant voltage at node 30 and is equal to the threshold voltage of transistor 28. The voltage delivered at node 30 is the final reference voltage $V_{REF}$.

Voltage reference 12 shown in FIG. 2 contains three major components: a first reference cell; a buffer and a second reference cell. The first reference cell is composed of a constant current source, implemented by depletion mode transistor 18, and a stable voltage reference, implemented by enhanced mode transistor 20. The constant current source for the first reference is implemented using depletion mode transistor 18 by coupling the gate and source terminals together such that the gate to source voltage difference is zero. Drain current, or quiescent current, flows through transistor 18 despite the gate to drain connection, due to the negative threshold voltage of depletion mode transistor 18. The constant current provided by transistor 18 is supplied as a first output of the voltage reference at node 22. Typical values of quiescent current for transistor 18 range from a few nano-amps (nA) to several micro-amps ($\mu$A), depending on the physical geometry of transistor 18. Transistor 20 is an enhanced mode device, meaning that a positive gate to source voltage is required for transistor 20 to conduct drain current. Given that transistor 18 is a constant current source and transistor 20 is diode connected, meaning that the drain terminal of transistor 20 is coupled to the gate terminal of transistor 20, the drain voltage of transistor 20 is given by the threshold voltage of transistor 20. The first reference voltage present at node 22 is called a pre-stabilized voltage reference.

Transistor 24 constitutes the second major component of voltage reference 12 and provides a high input impedance interface, or buffer, accepting a pre-stabilized voltage reference at node 22. Several significant features of voltage reference 12 are provided by transistor 24. A first significant feature of voltage reference 12 provided by transistor 24 is the negligible loading effect that transistor 24 presents to the output of the first reference cell. Transistor 24 requires virtually no current from the pre-stabilized voltage reference presented at node 22, subsequently allowing the first reference cell to operate substantially independently of the second reference cell. The high degree of isolation provided by transistor 24 allows the first reference cell to be coupled to, or cascaded with, the second reference cell. Cascading two reference cells has been shown by the present invention to significantly improve PSRR over single reference cell implementations.

A second feature of voltage reference 12 as provided by transistor 24 is the gate voltage to source voltage tracking capability provided by transistor 24. The voltage at the source terminal of transistor 24 follows the voltage presented at the gate terminal of transistor 24 with near unity gain. The source voltage of transistor 24 is therefore resistant to voltage fluctuations at the drain terminal of transistor 24, further isolating voltage reference 12 from the unregulated voltage potential $V_{dd}$. Transistor 24 is a depletion mode device and has a width divided by length ratio (w/1) which is greater than the w/1 ratio of transistor 18. The w/1 ratio exhibited by transistor 24 provides a slightly more positive source voltage than gate voltage. A typical value for w/1 ratio of transistor 24 is 5/1, which defines transistor 24 to be 5 times as wide as transistor 24 is long. A more positive source voltage than gate voltage existing on transistor 24 allows the second reference cell to operate at a potential value which is closer to the unregulated voltage potential, $V_{dd}$. Subsequently, by using transistor 24 as a buffer between the first reference cell and the second reference cell, a smaller potential drop between $V_{dd}$ and $V_{REF}$ can be realized which diminishes the voltage loss imposed by voltage reference 12. Diminishing the voltage loss imposed by voltage reference 12 effectively decreases the operating potential required by voltage reference 12 which makes voltage reference 12 more viable for use in sub-bandgap voltage applications requiring less than 1 volt operating potential.

The third component of voltage reference 12 is a second reference cell which may be, but not necessarily, identical to the first reference cell. The second reference cell, in contrast to the first reference cell, accepts a pre-stabilized, buffered input voltage at the drain terminal of transistor 26, rather than the unregulated voltage reference $V_{dd}$. The pre-stabilized, buffered input voltage from source follower transistor 24 is stabilized again by the second voltage reference cell and results in a 30–40 dB improvement of PSRR over prior art voltage references. The second voltage reference cell is implemented by coupling depletion mode transistor 26 and enhanced mode transistor 28 in the identical fashion as explained herein for transistor 18 and transistor 20, respectively, as shown in FIG. 2. Voltage reference 12 is referred to as a two-stage, stabilized voltage reference, since two reference cells are cascaded through a source follower buffer. In a second embodiment, a multiplicity of stages are cascaded whereby the resultant PSRR of the cascaded reference provides further improvement of PSRR. The cascaded embodiment is referred to as an n-stage, stabilized voltage reference, where n is equal to the number of voltage reference cells used in the cascade.

In summary, the present invention provides a stable voltage reference for use by a utilization circuit. The first reference cell accepts an unregulated voltage input and creates a pre-stabilized output voltage through the interaction of a depletion mode, constant current source transistor and an enhanced mode, diode connected voltage reference. The pre-stabilized output voltage of the first reference cell is then used to drive a high input impedance, near unity gain buffer which is highly resistive to power supply potential fluctuations. The pre-stabilized, buffered output voltage. is then used to drive a second reference cell comprised of a depletion mode, constant current source transistor and an enhanced mode, diode connected voltage reference which further stabilizes the output voltage. The second stage of stabilization allows for a significant increase in PSRR performance of the voltage reference over the prior art. In addition, the output voltage of the voltage reference is low enough such that the voltage reference can be used in low voltage, sub-bandgap applications.

What is claimed is:

1. A reference circuit, comprising:

a first transistor having a first conduction terminal coupled for receiving a first power supply potential and a control terminal coupled to a second conduction terminal to provide an output of the first transistor at a first node, wherein the first transistor is a depletion node device;

a first diode coupled for receiving the output of the first transistor and having an output for providing a first reference signal at the first node;

a buffer having an input coupled for receiving,the first reference signal;

a current source having an input coupled for receiving an output of the buffer; and a second diode coupled for receiving an output of the current source and having an output for providing a second reference signal at a second node.

2. The reference circuit of claim 1, wherein the first diode includes a second transistor having a first conduction terminal and a control terminal coupled together to the first node and a second conduction terminal coupled for receiving a second power supply potential.

3. The reference circuit of claim 2, wherein the second transistor is an enhancement mode device.

4. The reference circuit of claim 1, wherein the buffer includes a second transistor having a first conduction terminal coupled for receiving the first power supply potential, a control terminal coupled to the first node and a second conduction terminal coupled to the output of the buffer.

5. The reference circuit of claim 4, wherein the second transistor is a depletion mode device.

6. The reference circuit of claim 1, wherein the current source includes a second transistor having a first conduction terminal coupled to the output of the buffer and a control terminal coupled to a second conduction terminal of the second transistor at a second node for providing the second reference signal.

7. The reference circuit of claim 6, wherein the second transistor is a depletion mode device.

8. The reference circuit of claim 1, wherein the second diode includes a second transistor having first conduction terminal and a control terminal coupled together to the second node and a second conduction terminal coupled for receiving a second power supply potential.

9. The reference circuit of claim 8, wherein the second transistor is an enhancement mode device.

10. A circuit for providing a reference signal, comprising:

a first reference cell including, a first depletion mode transistor having an input coupled to a first power supply conductor, and a first diode having an anode coupled to an output of the first depletion mode transistor at a first node and a cathode coupled to a second power supply conductor;

a buffer having an input coupled to the first node; and a second reference cell including, a current source having an input coupled to an output of the buffer, and a second diode having an anode coupled to an output of the current source and having an output for providing the reference signal.

11. The reference circuit of claim 10, wherein the first diode includes a second transistor operating as an enhancement mode device.

12. The reference circuit of claim 10, wherein the buffer includes a second transistor operating as a depletion mode device.

13. The reference circuit of claim 10, wherein the current source includes a second transistor operating as a depletion mode device.

14. The reference circuit of claim 10, wherein the second diode includes a second transistor operating as a enhanced mode device.

15. An integrated circuit, comprising:

a utilization circuit; and a reference circuit providing a reference signal to an input of the utilization circuit the reference circuit including:

a first transistor having a first conduction terminal coupled for receiving a first power supply potential and a control terminal coupled to a second conduction terminal to provide an output of the first transistor at a first node, wherein the first transistor is a depletion mode device;

a first diode coupled for receiving an output of the first transistor and having an output for providing a first reference signal at the first node;

a buffer having an input coupled for receiving the first reference signal;

a current source having an input coupled for receiving an output of the buffer; and a second diode coupled for receiving an output of the current source and having an output for providing a second reference signal at a second node.

16. The integrated circuit of claim 15, wherein the first diode includes a second transistor having a first conduction terminal and a control terminal coupled together to the first node and a second conduction terminal coupled for receiving a second power supply potential.

17. The integrated circuit of claim 16, wherein the second transistor is an enhancement mode device.

18. The integrated circuit of claim 15, wherein the buffer includes a second transistor having a first conduction terminal coupled for receiving the first power supply potential, a control terminal coupled to the first node and a second conduction terminal coupled to the output of the buffer.

19. The integrated circuit of claim 18, wherein the second transistor is a depletion mode device.

20. The integrated circuit of claim 15, wherein the current source includes a second transistor having a first conduction terminal coupled to the output of the buffer and a control terminal coupled to a second conduction terminal of the second transistor at a second node for providing the second reference signal.

21. The integrated circuit of claim 20, wherein the second transistor is a depletion mode device.

22. The integrated circuit of claim 15, wherein the second diode includes a second transistor having a first conduction terminal and a control terminal coupled together to the second node and a second conduction terminal coupled for receiving a second power supply potential.

23. The integrated circuit of claim 22, wherein the second transistor is an enhancement mode device.

* * * * *